US009061848B2

(12) United States Patent
Okamoto

(10) Patent No.: US 9,061,848 B2
(45) Date of Patent: Jun. 23, 2015

(54) SHEET FEEDER AND IMAGE FORMING APPARATUS

(71) Applicant: Konica Minolta, Inc., Tokyo (JP)

(72) Inventor: Kenji Okamoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 13/968,790

(22) Filed: Aug. 16, 2013

(65) Prior Publication Data

US 2014/0061999 A1 Mar. 6, 2014

(30) Foreign Application Priority Data

Sep. 3, 2012 (JP) ..... 2012-193065

(51) Int. Cl.

| | |
|---|---|
| ***B65H 3/08*** | (2006.01) |
| ***B65H 3/04*** | (2006.01) |
| ***B65H 3/48*** | (2006.01) |
| ***B65H 7/02*** | (2006.01) |

(52) U.S. Cl.

CPC ..... *B65H 3/08* (2013.01); *B65H 3/047* (2013.01); *B65H 3/48* (2013.01); *B65H 7/02* (2013.01); *B65H 2405/15* (2013.01); *B65H 2406/1222* (2013.01); *B65H 2511/10* (2013.01); *B65H 2511/20* (2013.01); *B65H 2511/416* (2013.01); *B65H 2515/212* (2013.01); *B65H 2515/60* (2013.01); *B65H 2553/414* (2013.01); *B65H 2553/42* (2013.01); *B65H 2553/822* (2013.01); *B65H 2557/23* (2013.01); *B65H 2557/242* (2013.01); *B65H 2557/31* (2013.01); *B65H 2801/06* (2013.01)

(58) Field of Classification Search

CPC ..... B65H 3/48; B65H 2406/12; B65H 2406/122; B65H 3/14; B65H 2553/416

USPC ..... 271/97, 98, 105; 414/795.5

See application file for complete search history.

(56) References Cited

U.S. PATENT DOCUMENTS

| | | | | |
|---|---|---|---|---|
| 4,397,459 A * | 8/1983 | Silverberg et al. | ..... | 271/94 |
| 5,290,023 A * | 3/1994 | Sasaki et al. | ..... | 271/20 |
| 7,591,459 B2 * | 9/2009 | Matsumoto et al. | ..... | 271/97 |

(Continued)

FOREIGN PATENT DOCUMENTS

| | | | | |
|---|---|---|---|---|
| JP | 05306045 A * | 11/1993 | ..... | B65H 7/12 |
| JP | 2006-104723 | 4/2005 | | |
| JP | 2010-254462 A | 11/2010 | | |

OTHER PUBLICATIONS

Japanese Office Action, Notification of Reasons for Refusal, Patent Application No. 2012-193065: dispatch date: Oct. 28, 2014 and Ensh translation thereof (total of 4 pages).

*Primary Examiner* — Jeremy R Severson
(74) *Attorney, Agent, or Firm* — Lucas & Mercanti, LLP

(57) ABSTRACT

A sheet feeder includes an air blower adapted to blow air onto an end face of a stacked sheet bundle to thereby float the sheets of the sheet bundle, a conveying section adapted to convey the uppermost floated sheet, a brightness measuring section adapted to measure brightness of light reflected from the end face of the sheet bundle at two or more points in the height direction of the sheet bundle, a determination unit adapted to determine, based on the brightness of each point measured by the brightness measuring section, whether or not the air blowing amount of the air blower is appropriate, and a controller adapted to control the air blowing amount of the air blower based on the determination of the determination unit.

20 Claims, 8 Drawing Sheets

(56) References Cited

U.S. PATENT DOCUMENTS 7,770,884 B2 * 8/2010 Clark et al. ..... 271/105
7,913,993 B2 * 3/2011 Kosugi et al. ..... 271/98
8,485,517 B2 * 7/2013 Clark et al. ..... 271/105
2012/0154795 A1 * 6/2012 Kobayashi ..... 356/213

* cited by examiner

SHEET FEEDER AND IMAGE FORMING APPARATUS

CROSS REFERENCES TO RELATED APPLICATIONS

The present invention contains subject matter related to Japanese Patent Application JP 2012-193065 filed in the Japanese Patent Office on Sep. 3, 2012, the entire contents of which being incorporated herein by reference.

BACKGROUND OF THE INVENTION

1. Field of the Invention

The present invention relates to a sheet feeder and an image forming apparatus, and more particularly to an air blowing type sheet feeder and an image forming apparatus having such sheet feeder.

2. Description of the Related Art

An image forming apparatus, such as copying machine, a printer, a facsimile machine, a printing machine, a composite machine or the like, is provided with a sheet feeder adapted to feed sheets stacked in a sheet storage section one by one. Examples of the sheet feeder include an air blowing type sheet feeder. The air blowing type sheet feeder has a configuration in which air is blown to the upper portion of an end face of a sheet bundle to thereby float sheets, and the floated sheets are conveyed while being separated one by one.

In the air blowing type sheet feeder, it is necessary to adjust air blowing amount so as to prevent the case where air blowing amount is too large and therefore the sheets might be conveyed in a state where two or more sheets ore superimposed on each other or the case where air blowing amount is too small and therefore no sheet is floated. Conventionally, the adjustment of the air blowing amount is previously performed by the distributor of the image forming apparatus for each different size and type of sheet.

However, due to different warpage of the sheet (which varies depending on temperature), different cutting condition of the sheet (which differs for each paper maker), and/or the like, appropriate air blowing amount may be different even for the sheets of the same size and type. Thus, before actually performing image forming process, the user has to float the sheets of the sheet feeder and operate an operation unit of the sheet feeder to fine-adjust the air blowing amount while confirming the floating state of the sheets by visual observation.

Further, there is also a proposal in which a camera is used to take an image between the uppermost sheet and the sheet below the uppermost sheet in a state where the sheets are floated, the distance between the two sheets is calculated based on the image taken by the camera, and the air blowing amount is automatically adjusted according to the calculated distance (see, for example, Japanese Unexamined Patent Application Publication No. 2010-254462).

SUMMARY OF THE INVENTION

However, fine-adjusting the air blowing amount while confirming the floating state of the sheets by visual observation is a cumbersome work. Further, in the art proposed in the aforesaid Japanese Unexamined Patent Application Publication No. 2010-254462, since it is necessary to perform a complicated operation to calculate the distance between the two sheets based on the image taken by the camera, and also since the sheet in the floated state flaps and moves, it is difficult to correctly calculate the distance between the two sheets.

In view if the aforesaid problems, it is a main object of the present invention to make it possible to adjust the air blowing amount for floating the sheets in an air blowing type sheet feeder without necessity for user to confirm the floating state of sheets by visual observation, and without necessity to perform complicated operation.

To achieve the aforesaid object, a sheet feeder according to an aspect of the present invention comprises: an air blower adapted to blow air onto an end face of a stacked sheet bundle to thereby float the sheets of the sheet bundle; a conveying section adapted to convey the uppermost floated sheet; a brightness measuring section adapted to measure brightness of light reflected from the end face of the sheet bundle at two or more points in the height direction of the sheet bundle; a determination unit adapted to determine, based on the brightness of each point measured by the brightness measuring section, whether or not the air blowing amount of the air blower is appropriate; and a controller adapted to control the air blowing amount of the air blower based on the determination of the determination unit.

Further, an image forming apparatus according to another aspect of the present invention comprises: an image forming section adapted to transfer a toner image formed on a photoreceptor to a sheet; and a sheet feeding section adapted to feed sheets to the image forming section, wherein the sheet feeding section comprises: an air blower adapted to blow air onto an end face of a stacked sheet bundle to thereby float the sheets of the sheet bundle; a conveying section adapted to convey the uppermost floated sheet; a brightness measuring section adapted to measure brightness of light reflected from the end face of the sheet bundle at two or more points in the height direction of the sheet bundle; a determination unit adapted to determine, based on the brightness of each point measured by the brightness measuring section, whether or not the air blowing amount of the air blower is appropriate; and a controller adapted to control the air blowing amount of the air blower based on the determination of the determination unit.

DETAILED DESCRIPTION OF THE PREFERRED EMBODIMENT

An embodiment for carrying out the present invention will be described below with reference to the attached drawings.

Note that, in the following description and attached drawings, the same components or the components having the same function are denoted by the same numerals, and the explanation thereof will not be repeated.

Sheet Feeder

Figure 1:
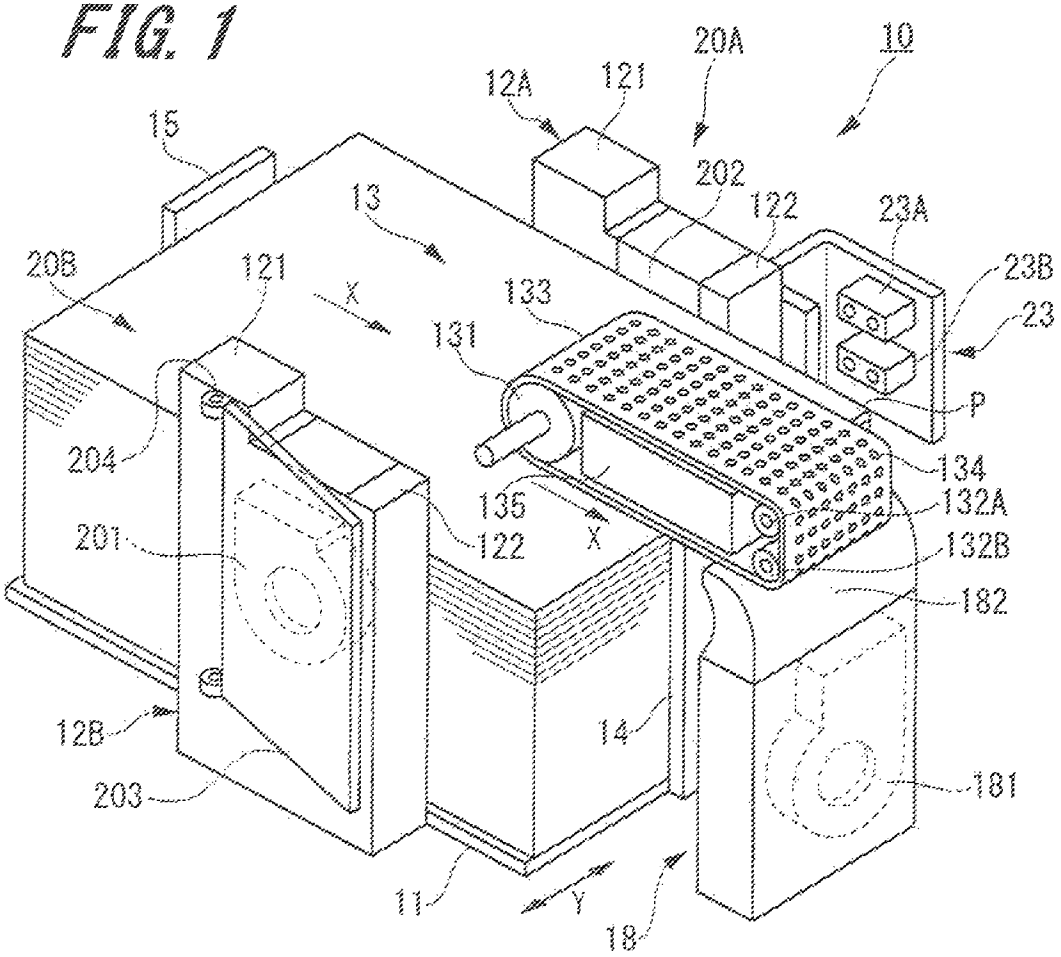
FIG. 1 is a perspective view showing a primary portion of a sheet feeder according to an embodiment of the present invention.
Figure 2:
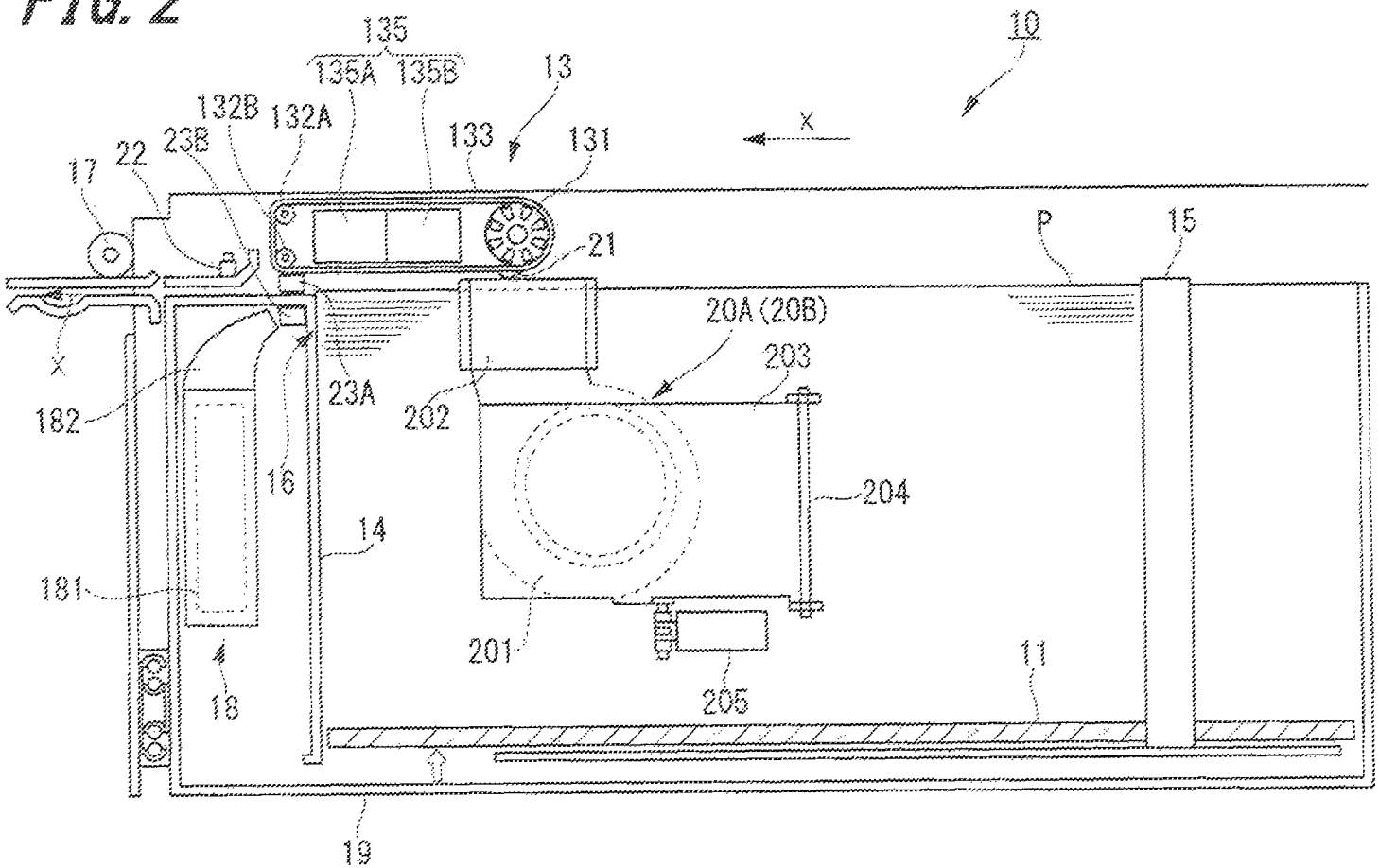
FIG. 2 is a cross section taken along the paper feeding direction of the sheet feeder according to the aforesaid embodiment.

FIG. 1 is a perspective view showing a primary portion of a sheet feeder 10 according to an embodiment of the present invention, and FIG. 2 is a cross section taken along the paper feeding direction of the sheet feeder 10.

The sheet feeder 10 according to the present embodiment is an air blowing type sheet feeder which blows air into between sheets P of a sheet bundle stacked on a sheet feeding tray 11 from the end face of the sheet bundle, to thereby feed sheets P while separating the sheets P one by one. The concrete configuration of the air blowing type sheet feeder 10 will be described below with reference to FIGS. 1 and 2.

As shown in FIGS. 1 and 2, the sheet feeding tray 11 on which the sheets P are stacked can be raised and lowered by an elevating mechanism (not shown). In other words, the sheets P are stacked in the sheet feeding tray 11 in an elevatable manner. Two lateral-end regulating members 12A, 12B are arranged on both lateral sides of the sheets P stacked on the sheet feeding tray 11. The lateral-end regulating members 12A, 12B can be moved in a width direction of the sheets P (i.e., the direction of arrow Y), and is adapted to regulate the position of both lateral ends of the sheets P by lightly pressing the sheets P from both lateral sides corresponding to the width of the sheets P stacked on the sheet feeding tray 11.

Since the lateral-end regulating member 12A and the lateral-end regulating member 12B basically have the same configuration, herein only the configuration of the lateral-end regulating member 12A will be described as an example. The lateral-end regulating member 12A has a step formed in its top. To be specific, the lateral-end regulating member 12A has an upstream-side upper surface 121 and a downstream-side upper surface 122 in the conveying direction of the sheet P, i.e., in the paper feeding direction (the direction of arrow X), wherein the upstream-side upper surface 121 is relatively high, and the downstream-side upper surface 122 is relatively low.

Although not shown in the drawings, a supporting member for supporting the upper end of the lateral-end regulating member 12A is attached to the upstream-side upper surface 121. The downstream-side upper surface 122 overlaps with a sucking and conveying section 13 (which is to be described later) in the conveying direction of the sheets P. When drawing out the sheet feeding tray 11 along the direction of arrow Y shown in FIG. 1 to load sheets, the downstream-side upper surface 122 can passes under the sucking and conveying section 13.

A front-end regulating member 14 is arranged on the side of the front end of the sheets P stacked on the sheet feeding tray 11 in the conveying direction (i.e., the direction of arrow X), and a rear-end regulating member 15 is arranged on the side of the rear end of the sheets P. The front-end regulating member 14 regulates the position of the front end of the sheet P in the conveying direction. The rear-end regulating member 15 can be moved in the conveying direction of the sheet P, and is adapted to regulate the position of the rear end of the sheet P in the conveying direction by lightly pressing the sheets P from the side of the rear end.

Further, as shown in FIG. 2, the front-end regulating member 14 is provided with a height defecting sensor 16 for detecting the height of the uppermost sheet P.

Base on the detection result of the height detecting sensor 16, a controller 30 (see FIG. 4), which is to be described later, performs control to drive an elevating motor (not shown) to raise the sheet feeding tray 11, to thereby maintain the height of the sheet bundle stacked on the sheet feeding tray 11 at the most suitable height for blowing air and separating the sheets P.

The sucking and conveying section 13 is arranged in the vicinity of the front end of the sheets P in the conveying direction (the direction of arrow X). The sucking and conveying section 13 has a large roller 131, two small rollers 132A, 132B, and a loop-like suction belt 133, wherein the large roller 131 is connected to a driving source, the two small rollers 132A, 132B are separated from the large roller 131 by a predetermined distance, and the suction belt 133 is revolved around the large roller 131 and the two small rollers 132A, 132B.

The suction belt 133 has many small-diameter through-holes 134 bored therethrough. A suction device 135 is arranged inside the loop-like suction belt 133. The suction device 135 sucks the sheet P through the through-holes 134 bored through the suction belt 133. In other words, the sucking and conveying section 13 is configured such that the sheet P is conveyed by the suction belt 133 toward a sheet feeding roller 17 shown in FIG. 2 while the sheet P is sucked to the suction belt 133 by the suction device 135.

The suction device 135 is partitioned into two suction duct 135A, 135B along the conveying direction of the sheet P (i.e., the direction of arrow X), so that it is possible to switch between a case where the sheet P is sucked only by the suction duct 135A and a case where the sheet P is sucked by both the suction duct 135A and suction duct 135B.

A front air blower 18 is arranged near the sheet P stacked on the sheet feeding tray 11 on the side of the sheet feeding destination. The front air blower 18 is configured by an air blowing fan 181, an air duct 182 and the like, and is fixed to a sheet feeder main body 19. In the front air blower 18, the air blowing fan 181 blows air upward, and the air duct 182 changes the direction of the air blown by the air blowing fan 181 so that the air is blown onto the upper front end face of the sheet bundle stacked on the sheet feeding tray 11.

The driving of the front air blower 18 is controlled by a controller 30 (see FIG. 4), which is to be described later, according to the type of the sheet P. To be specific, under the control or the controller 30, amount of the air blown by the air blowing fan 181 is controlled according to type of sheet P, such as an OHP film, a tracing paper, a coated paper having a smooth surface, a paper subjected to treatment such as perforation treatment, folding treatment or the like, an offset printed paper with floured surface, and the like. The front air blower 18 will be described in more detail later.

Further, two lateral air blowers 20A, 20B are arranged on both lateral sides of the sheets P stacked on the sheet feeding tray 11. The lateral air blowers 20A, 20B blow air from both lateral sides in a direction perpendicular to the conveying direction of the sheet P (i.e., the direction of arrow X) onto the upper end face of the sheet bundle stacked on the sheet feeding tray 11.

To be more specific, the lateral air blowers 20A, 20B each have an air blowing fan 201 and an air blowing port 202, wherein the air blowing port 202 is adapted to blow the air from the air blowing fan 201 onto the upper end face of the sheet bundle. The air blowing port 202 is arranged below the downstream-side upper surface 122 of each of the lateral-end regulating members 12A, 12B, and the air blowing port 202 at least partly overlaps with the sucking and conveying section 13 in the conveying direction of the sheet P. In other words, as shown is FIG. 2, a part of the air blowing port 202 on the side of the front end is located under the suction belt 133.

The lateral air blowers 20A, 20B are arranged inside the lateral-end regulating members 12A, 12B. Thus, by moving the lateral-end regulating members 12A, 12B, the lateral air blowers 20A, 20B can be moved together, even in the case where the size of the sheet P is changed. Incidentally, although, the present embodiment is described based on a configuration in which two lateral air blowers 20A, 20B are provided on both lateral sides of the sheets P, the present invention also includes a configuration in which only the lateral air blower 20A or the lateral air blower 20B is provided on one lateral side of the sheets P.

In each of the lateral air blowers 20A, 20B, the air blowing fan 201 is driven to blow air from the air blowing port 202 to below the sucking and conveying section 13, so that the air is blown toward several pieces of sheets in the upper portion of the stacked sheet bundle. The air is blown from one end of the sheets P toward the other end passing through the interspaces between adjacent sheets. Due to being blown by the air, the sheets P are separated, and several sheets in the upper portion of the sheet bundle are separated one by one. Among the separated sheets P, the sucking and conveying section 13 only sucks the uppermost sheet P.

The air intake port of each of the lateral air blowers 20A, 20B can be selectively shielded by a shielding member 203 which can be freely opened and closed. To be more specific, the shielding member 203 (which is configured by a plate-like shutter) is pivotally supported by a shaft 204, and is opened and closed by the driving of a solenoid 205. The controller 30 (which is to be described later) controls the opening/closing of the shielding member 203 to thereby switch the air blowing of the lateral air blowers 20A, 20B between ON (blowing air) and OFF (stop blowing air).

As shown in FIG. 2, a suction detecting sensor 21 is arranged in the vicinity of the suction surface of the suction belt 133. The suction detecting sensor 21 detects the fact that the sheet P has been sucked by the suction belt 133. Upon receiving the detection result of the suction detecting sensor 21, the suction belt 133 starts to revolve under the control of the controller 30 (which is to be described later), so that the conveyance of the sheet P is started.

Further, a feeding sensor 22 is arranged in the vicinity of the suction belt 133 on the downstream side of the conveying direction. The feeding sensor 22 detects the passage of the sheet P conveyed by the suction belt 133. If the suction belt 133 continues to revolve while sucking the sheet P, the uppermost sheet P of the sheet bundle will moves ahead along the direction of arrow X shown in FIG. 2, so as to be nipped by the sheet feeding roller 17 and sent to the sheet feeding destination.

Figure 3:
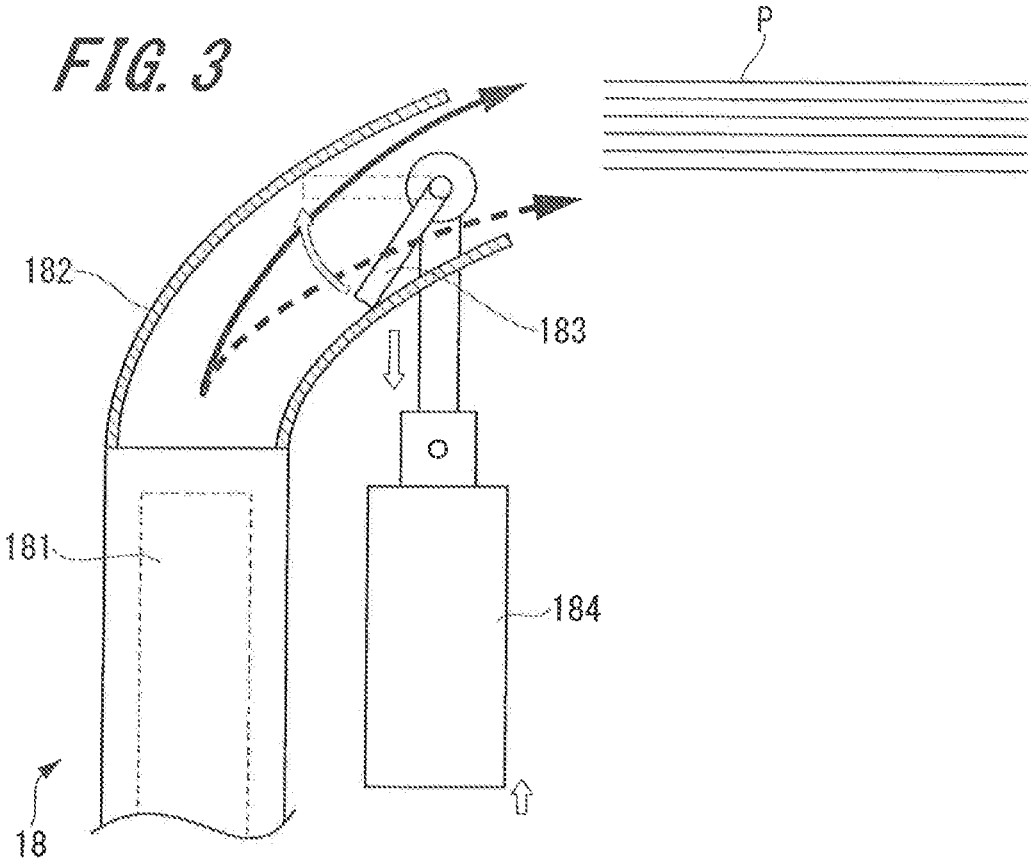
FIG. 3 is a view showing the details of a front air blower.

FIG. 3 is a view showing the details of the front air blower 18. As described above, the front air blower 18 is configured by the air blowing fan 181, the air duct 182 and the like. In the front air blower 18, the air blown by the air blowing fan 181 is blown, through the air duct 182, onto the front end face of the upper portion of the stacked sheet bundle.

A sheet front end shutter 183 is arranged at the outlet port of the air duct 182. Under the control of the controller 30 (which is to be described later), the sheet front end shutter 183 is driven by a solenoid 184 to thereby control the blowing angle of the air blown from the air duct 182.

To be more specific, when the solenoid 184 is turned OFF, the sheet front end shutter 183 will be turned to a blowing angle indicated by the solid line, so that the air will be blown above the sheets P, and thereby the uppermost sheet P is separated. While when the solenoid 184 is turned ON, the sheet front end shutter 183 will be turned to a blowing angle indicated by the broken line, so that the air will be blown into the sheets P from the front end face of the sheet bundle, so that, the sheets P in the upper portion of the sheet bundle are floated.

The sheet feeder 10 leaving the aforesaid configuration is an air blowing type sheet feeder in which the air from the air blower (i.e., the front air blower 18 and the lateral air blowers 20A, 20B) is blown into between the sheets P of the sheet bundle stacked on the sheet feeding tray 11 from the end faces of the sheet bundle, so that the sheets P are fed forward while being separated one by one. Here, as an example, when separating the sheets P one by one, it is possible to position the front air blower 18 as a main air blowing means and the lateral air blowers 20A, 20B as an accessory (auxiliary) air blowing means.

As shown in FIG. 1, a brightness measuring section 23 is arranged near the upper portion of the sheets P blown by air. The brightness measuring section 23 is adapted to measure the brightness of the light reflected from the end face of the sheet bundle at two points in the height direction of the sheets P, and includes two brightness sensors 23A, 23B each having a light-emitting portion and a light-receiving portion. As an example, the distance between the brightness sensor 23A and the brightness sensor 23B is about 10 nm. Incidentally, in FIG. 2, only the brightness sensors 23A, 23B are shown, and the brightness measuring section 23 main body is omitted.

Figure 4:
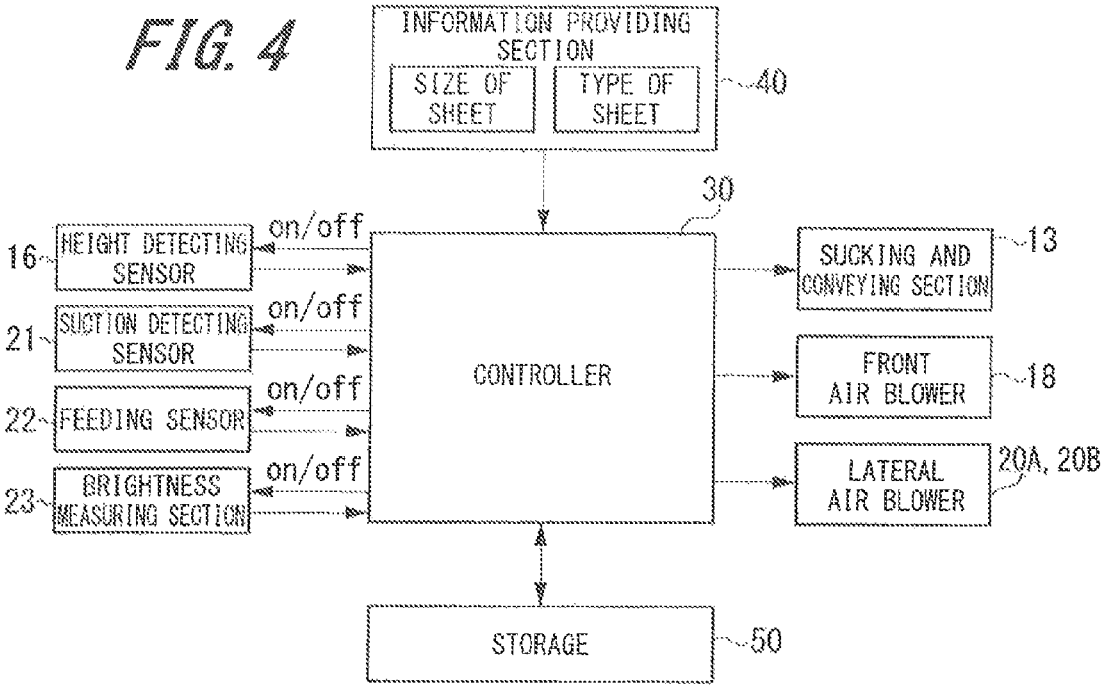
FIG. 4 is a block diagram for explaining a configuration example of a control system of the sheet feeder according to the aforesaid embodiment.

FIG. 4 is a block diagram for explaining a configuration example of a control system of the sheet feeder 10 according to the present embodiment. As shown in FIG. 4, the controller 30 and a storage 50 may each be configured by a microcomputer, for example. However, the controller 30 is not limited to be configured by a microcomputer, but may also be configured by hardware. As an example, in the present embodiment, a determination unit for determining whether or not the air blowing amount of the air blower is appropriate based on she brightness of the respective points measured by the brightness measuring section 23 and a controller for controlling the air blowing amount of the air blower based on the determination result are configured by the controller 30 and the storage 50.

Various kinds of information (data) such as information about start of sheet feeding, information about size and type of the sheet P and the like are inputted from an information providing section 40 to the controller 30. Examples of the size of the sheet P include A4-size, B4-size, A3-size and the like. Examples of the type of the sheet P include a plain paper, a high-quality paper, a coated paper having a smooth surface, an OHP film, a tracing paper, a thick paper, a gloss paper and the like. The information providing section 40 includes a sensor for automatically determining the size and type of the sheet P, an operation unit for user to arbitrarily perform designating operation, and the like.

The controller 30 performs ON/OFF control with respect to the aforesaid height defecting sensor 16, suction detecting sensor 21 and feeding sensor 22. Further, ON/OFF information detected by the height detecting sensor 16, suction detecting sensor 21 and feeding sensor 22 is inputted to the controller 30. Further, information about the brightness of the sheets P measured by the brightness sensors 23A, 23B of the brightness measuring section 23 is inputted from the brightness measuring section 23 to the controller 30. The controller 30 controls, based on the all information inputted thereto, the aforesaid sucking and conveying section 13, front air blower 18, the lateral air blowers 20A, 20B, and the like.

To be specific, as described above, based on the ON/OFF information detected by the height defecting sensor 16, the controller 30 performs control to drive the elevating motor (not shown) to raise the sheet feeding tray 11. Further, based on the ON/OFF information detected by the suction detecting sensor 21, the controller 30 performs control to drive the sucking and conveying section 13 to start conveying the sheet P. Further, based on the ON/OFF information detected by the feeding sensor 22, the controller 30 performs control for the sucking and conveying section 13 to stop conveying the sheet P.

Further, based, on the information about the type of the sheets P provided by the information providing section 40, the controller 30 controls the amount of the air blown from the front air blower 18 and the lateral air blowers 20A, 20B. Further, based on the information about the brightness of the sheets P measured by the brightness sensors 23A, 23B of the brightness measuring section 23, the controller 30 controls the amount of the air blown from the lateral, air blowers 20A, 20B.

Before describing an air blowing amount adjusting process of the controller 30 based on the measurement result of the brightness measuring section 23, the relationship between the floating state of the sheets P and the brightness of the light reflected from the end face of the sheet bundle will be described first with reference to FIG. 5. The middle view of FIG. 5 shows a brightness distribution of the light reflected from the end face of the sheet bundle obtained in a state where substantially uniform spaces are formed below the uppermost floated sheet P between a plurality of sheets P including the uppermost sheet P and where it is possible to convey the sheets P while separating the sheets P one by one (i.e., in a state where the air blowing amount is appropriate).

Figure 5:
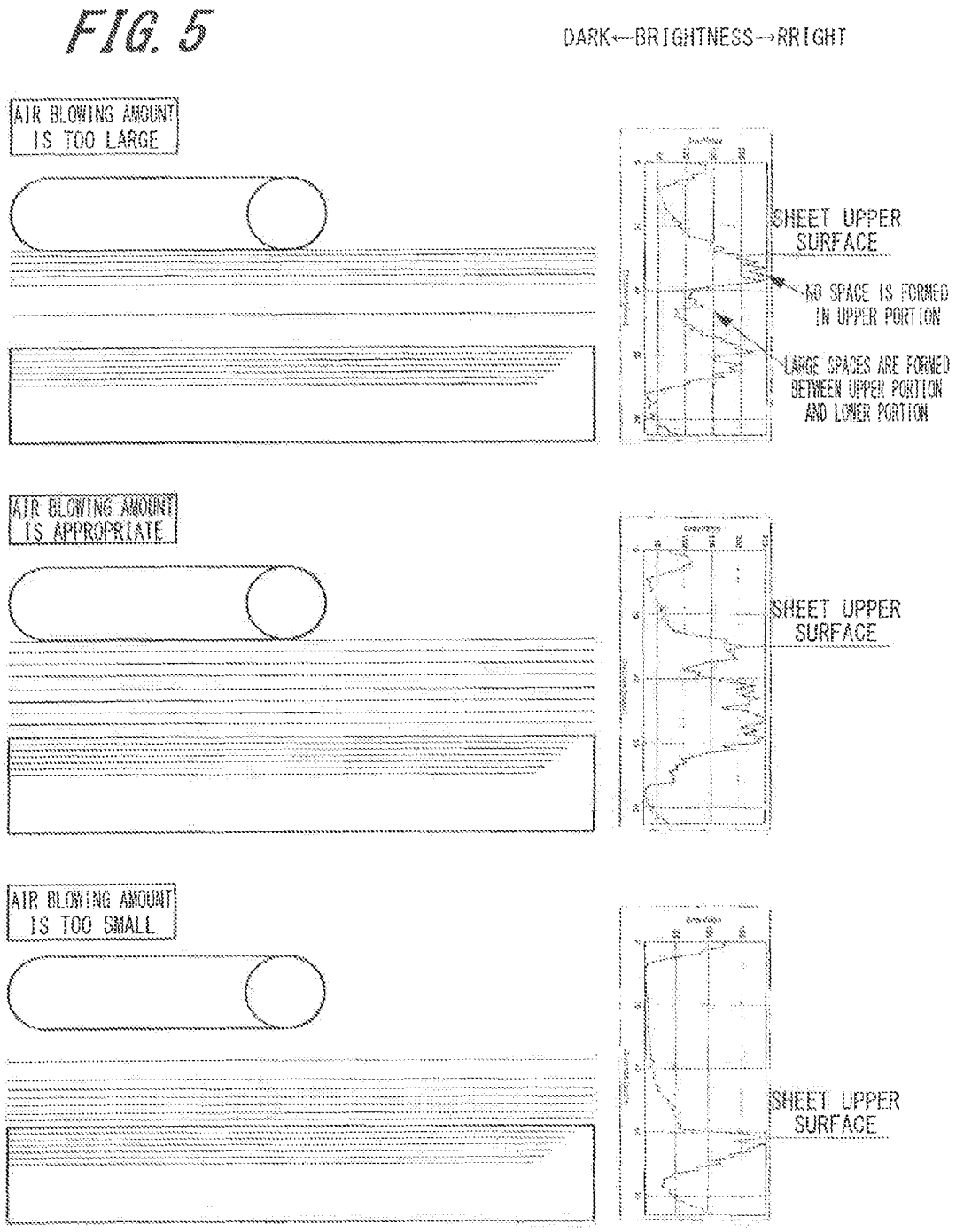
FIG. 5 is a view showing the relationship between floating state of a sheet bundle and brightness of light reflected from the end face of the sheet bundle.

In contrast, the upper view of FIG. 5 shows a brightness distribution of the light reflected from the end face of the sheet bundle obtained in a state where, since the air blowing amount is too large, no space is formed in a first portion, which is a portion immediately below the uppermost floated sheet P, between a plurality of sheets P including the uppermost sheet P while large spaces are formed in a second portion, which is a portion below the first portion, and where there is a concern that the sheets P might be conveyed in a state where two or more sheets are superimposed on each other.

Further, the lower view of FIG. 5 shows a brightness distribution of the light reflected from the end face of the sheet bundle obtained in a state where, since the air blowing amount is too small, no sheet P is floated and therefore the position of the uppermost sheet P is low.

Information about setting range of the brightness is previously stored in the storage 50 based on the relationship between the floating state of the sheets P and the brightness of the sheet bundle shown in FIG. 5. The information about setting range of the brightness will be described below with reference to FIG. 6. As shown in the middle view of FIG. 5, in the state where the air blowing amount is appropriate and substantially uniform spaces are formed between a plurality of sheets P including the uppermost sheet P, since sheets respectively exist in the positions corresponding to the height of the brightness sensor 23A and the height of the brightness sensor 23B of the brightness measuring section 23, the value of the brightness measured by the brightness sensor 23A and the value of the brightness measured by the brightness sensor 23B are close to each other. The middle view of FIG. 6 shows a range of the brightness of the sheet bundle measured in the positions corresponding to the heights of the brightness sensors 23A, 23B shown in the state of the middle view of FIG. 5 (which is a range with "a" as the lower limit value, "a+b" as the upper limit value, and "b" as the width).

Figure 6:
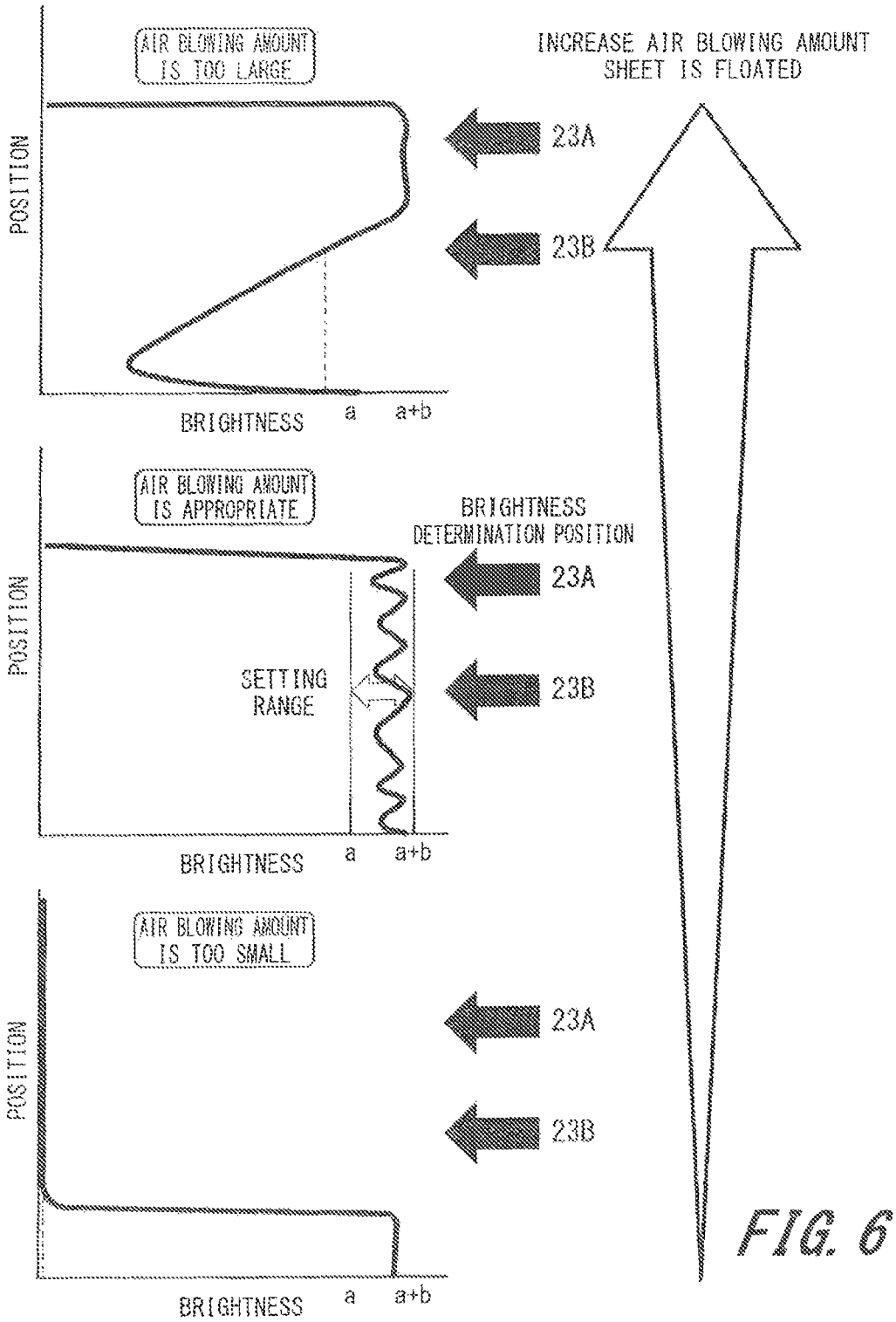
FIG. 6 is a view showing information about setting range of the brightness stored in a controller.

In contrast, in the state shown in the upper view of FIG. 5 where the air blowing amount is too large, since large spaces are formed between the sheets in the position corresponding to the height of the brightness sensor 23B (which is the lower brightness sensor of the two brightness sensors 23A, 23B of the brightness measuring section 23), as shown in the upper view of FIG. 6, the brightness measured by the brightness sensor 23B is smaller than the lower limit value "a", instead of falling within a range defined by the lower limit value "a" and the width "b".

Further, in the state shown in the lower view of FIG. 5 where the air blowing amount is too small, since no sheet exists in the positions corresponding to the height of the brightness sensors 23A, 23B, as shown in the lower view of FIG. 6, the brightness measured by the brightness sensors 23A, 23B is smaller than the lower limit value "a", instead of falling within a range defined by the lower limit value "a" and the width "b".

As information about setting range of the brightness, information about the lower limit value "a" and the width "b" shown in the middle view of FIG. 6 is stored in the storage 50.

The arrange of the brightness of the sheet bundle measured in positions corresponding to the heights of the brightness sensors 23A, 23B in the state where the air blowing amount is appropriate may vary depending on the size and type of the sheet. Thus, information about setting range of the brightness (i.e., the lower limit value "a" and the width "b") is stored in the storage 50 for each size and type of the sheet.

Next, the air blowing amount adjusting process performed by the controller 30 based on the measurement result of the brightness measuring section 23 will be described below with reference to the flowchart shown in FIG. 7. The air blowing amount adjusting process is performed in a period while the sheet feeder 10 is not performing sheet feeding operation (i.e., an operation for sending the sheet to the sheet feeding destination), and is started as soon as information for instructing the start of the air blowing amount adjustment is inputted from the information providing section 40 to the controller 30 by operating the operation unit of the information providing section 40 shown in FIG. 4. However, for example, even if the air blowing amount adjusting process has been performed before the sheet feeding operation is performed, there is a possibility that the appropriate air blowing amount may change when performing sheet feeding operation thereafter due variation of the temperature and/or the like. To solve such a problem, the controller 30 starts the air blowing amount adjusting process even in the period when the sheet feeding operation is performing the sheet feeding operation.

When performing the air blowing amount adjustment, first, the controller 30 sets the air blowing amount of the lateral air blowers 20A, 20B to the lowest step and causes the lateral air blowers 20A, 20B to drive (step S1). Next, the controller 30 acquires the information about the measurement result of the brightness sensors 23A, 23B inputted from the brightness measuring section 23 (step S2).

Next, in the information about the setting range of the brightness (the lower limit value "a" and the width "b") for each size and type of the sheet previously stored in the storage 50, the controller 30 reads out the information about the setting range corresponding to the size and type of the sheet inputted from the information providing section 40 end compares the read out information about the setting range with the measurement result of the brightness sensors 23A, 23B (step S3). Next, the controller 30 determines whether or not the brightness of the sheet measured by the brightness sensor 23A and the brightness of the sheet measured by the brightness sensor 23B both fall within the setting range (step S4).

If the determination result is "NO", the controller 30 will, increase the air blowing amount of the lateral air blowers 20A, 20B by one step (step S5), and return the process to step S2. The controller 30 repeatedly performs steps S2 to S5 until the determination result in step S4 becomes "YES"; and if the determination result in step S4 becomes "YES", the controller 30 will determine that air blowing amount of the lateral air blowers 20A, 20B is appropriate, and end the air blowing amount adjusting process.

In the sheet feeder 10 according to the present embodiment, the brightness of the light reflected from the end face of the sheet bundle at the two points in the height direction of the stacked sheet bundle is measured by the brightness sensors 23A, 23B of the brightness measuring section 23. Further, the controller 30 repeatedly executes a routine, which is programmed to determine whether or not the brightness measured by the brightness sensors 23A, 23B falls within the previously stored setting range of the brightness (i.e., the lower limit value "a" and the width "b") while changing the air blowing amount of the lateral air blowers 20A, 20B, until the determination result becomes positive; and if the determination result becomes positive, the controller 30 will determine that the air blowing amount of the lateral air blowers 20A, 20B is appropriate.

Thus, it is possible to automatically adjust the air blowing amount of the lateral air blowers 20A, 20B to appropriate level without necessity for the user to operate the operation unit of the information providing section 40 to adjust the air blowing amount of the lateral air blowers 20A, 20B while confirming the floating state of sheets by visual observation. Further, the process of the controller 30 is a simple process of comparing the measured brightness with the setting range, instead of being a complicated operation. Thus, in the sheet feeder 10, the air blowing amount for floating the sheets can be automatically adjusted to appropriate level without necessity for the user to perform operation while confirming the floating state of sheets by visual observation, and without necessity for the controller 30 to perform a complicated operation.

MODIFICATIONS

It is to be understood that the present invention is not limited to the embodiment described above, and various modifications and variations can be made without departing from the spirit and scope of the present invention.

For example, in the above embodiment, the brightness of the light reflected from the end face of the sheet bundle at the two points in the height direction of the stacked sheet bundle is measured by the brightness sensors 23A, 23B. However, the present invention also includes a configuration in which, instead of the brightness sensor, a camera is used to take an image of the sheet bundle, and the brightness of the light reflected from the end face of the sheet bundle at the two points in the height direction of the stacked sheet bundle is measured based on the image taken by the camera.

Further, in the above embodiment, the brightness of the light reflected from the end face of the sheet bundle at two points in the height direction of the stacked sheet bundle is measured; however, the present invention also includes a configuration in which the brightness of the light reflected from the end face of the sheet bundle at three points in the height direction of the stacked sheet bundle is measured. By increasing the number of the measurement points, it is possible to more accurately determine whether or not a state where substantially uniform spaces are formed between a plurality of sheets including the uppermost sheet (i.e., a state where the air blowing amount is appropriate), as shown in the middle view of FIG. 5, is obtained.

Figure 7:
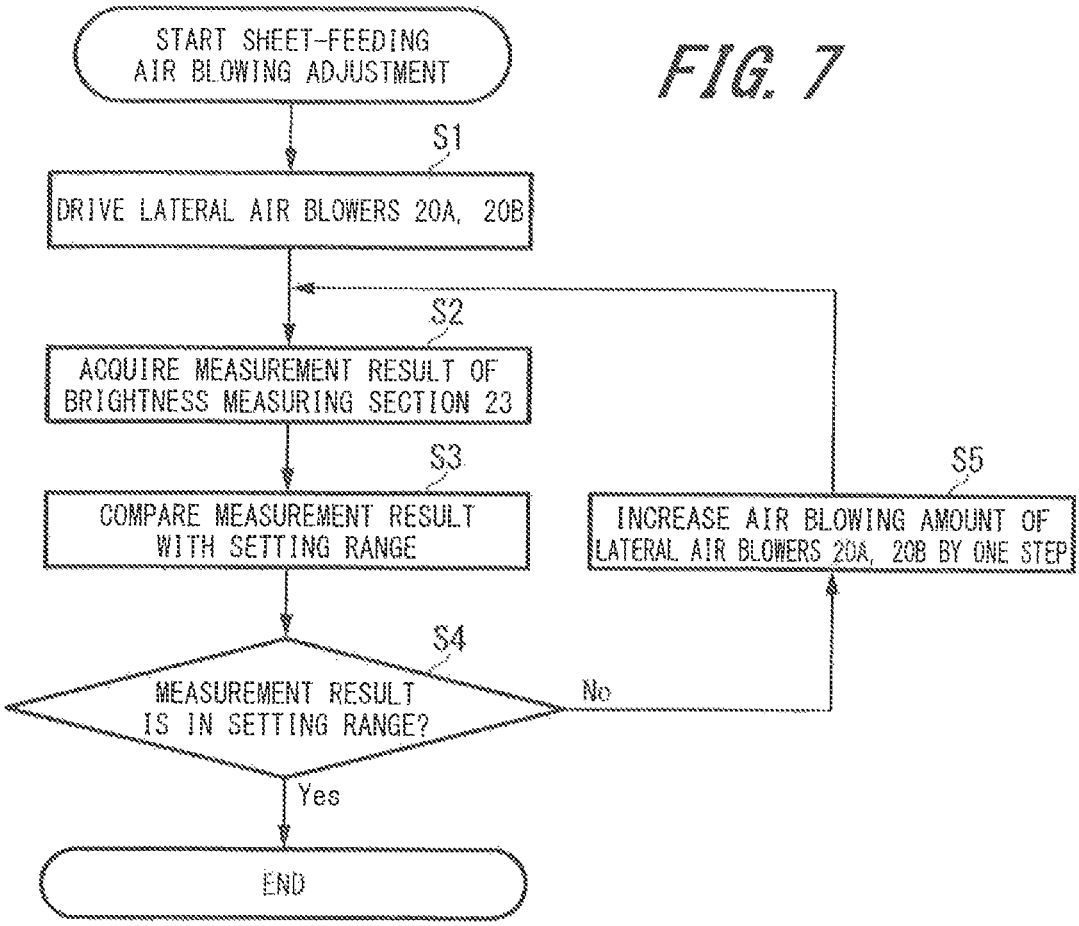
FIG. 7 is a flowchart for explaining a processing performed by the controller based on the measurement result of a brightness measuring section.

Further, in the above embodiment, the controller 30, which also serves as an air blowing amount controller for controlling the air blowing amount of the lateral air blowers 20A, 20B, performs single-handedly the whole air blowing amount adjusting process shown in FIG. 7. However, the present invention also includes a configuration in which, among all steps of the air blowing amount adjusting process, the steps S2 to S4 relevant to the comparison between the measurement result of the brightness sensors 23A, 23 and the setting range of the brightness previously stored in the storage 50 and the determination are executed by a dedicated determination controller (which is another example of the determination unit) configured either by a microcomputer other than the controller 30 or by hardware.

Further, in the above embodiment, as shown in FIG. 7, there is a routine, which is programmed to determine whether or not the brightness measured by the brightness sensors 23A, 23B falls within the previously stored setting range of the brightness (i.e., the lower limit value "a" and the width "b") while changing the air blowing amount of the lateral air blowers 20A, 20B. The controller 30 repeatedly executes the routine until, the determination result becomes positive; and if the determination result becomes positive, the controller 30 will determine that the air blowing amount of the lateral air blowers 20A, 20B is appropriate. However, the present invention also includes a configuration in which information for designating the air blowing amount of the lateral air blowers 20A, 20B is inputted from the information providing section 40 to the controller 30 by operating the information providing section 40; and based such information, the controller 30 only executes the processing of steps S2 to S4 among the steps of FIG. 7, and displays the determination result on the information providing section 40. To such a case, the user can adjust the air blowing amount for floating the sheets of the sheet feeder 10 to appropriate level only by operating the information providing section 40 to input information for changing the air blowing amount of the lateral air blowers 20A, 20B to the controller 30 so that the determination result in step S4 becomes positive, without necessity for the user to confirm the floating state of the sheets by visual observation.

Further, in such a case, the sheet feeder 10 may also be connected to an information terminal of the distributor of the sheet feeder 10 via the Internet so as to send the determination result in step S4 from the sheet feeder 10 to the information terminal; and the information for changing the air blowing amount of the lateral air blowers 20A, 20B so that the determination result in step S4 becomes positive is sent to the controller 30 of the sheet feeder 10 by operating the information terminal. With such a configuration, it becomes possible for the staff in the distributor of the sheet feeder 10 to adjust the air blowing amount for floating the sheets of the sheet feeder 10 to appropriate level without going off to the installation site of the sheet feeder 10.

Further, in the above embodiment, the controller 30 previously store the information about setting range of the brightness (i.e., the lower limit value "a" and the width "b") in the storage 50, and compares the setting range with the measurement result of the brightness sensors 23A, 23B of the brightness measuring section 23. However, the present invention also includes a configuration in which the controller 30 determines whether on not the value of the brightness measured by the brightness sensor 23A and the value of the brightness measured by the brightness sensor 23B are each larger than a certain value (corresponding to the lower limit value "a" of the setting range) and the range of the brightness measured by the brightness sensor 23A and the range of the value or the brightness measured by the brightness sensor 23B are each smaller than a certain value (corresponding to the width "b" of the setting range); and if the determination result is positive, the controller 30 will determine that the air blowing amount of the lateral air blowers 20A, 20B is appropriate.

Further, in the above embodiment, only one brightness measuring section 23 is provided; however, the present invention also includes a configuration in which a plurality of brightness measuring sections 23 are arranged around the stacked sheet bundle (in positions on the front, back, right, and left of the sheet, bundle when viewed from the conveying direction). In such a case, the controller 30 may either determine that the air blowing amount of the lateral air blowers 20A, 20B is appropriate if the determination results in step S4 shown in FIG. 7 obtained by all brightness measuring sections 23 are "YES", or estimate the floating state of the central portion of the sheet bundle based on the determination result in step S4 shown in FIG. 7 of each brightness measuring section 23, and determine whether or not the air blowing amount of the lateral air blowers 20A, 20B is appropriate according to the estimation result.

Image Forming Apparatus

The sheet feeder 10 according to the present embodiment can be preferably applied to a sheet feeder for feeding sheet to an image forming apparatus. Examples of the image forming apparatus which uses the sheet feeder 10 according to the present embodiment include a copying machine, a printer, a facsimile machine, a printing machine, a composite machine and the like. The following description is based on an example in which the image forming apparatus which uses the sheet feeder 10 according to the present embodiment (i.e., the image forming apparatus of the present invention) is a copying machine.

Figure 8:
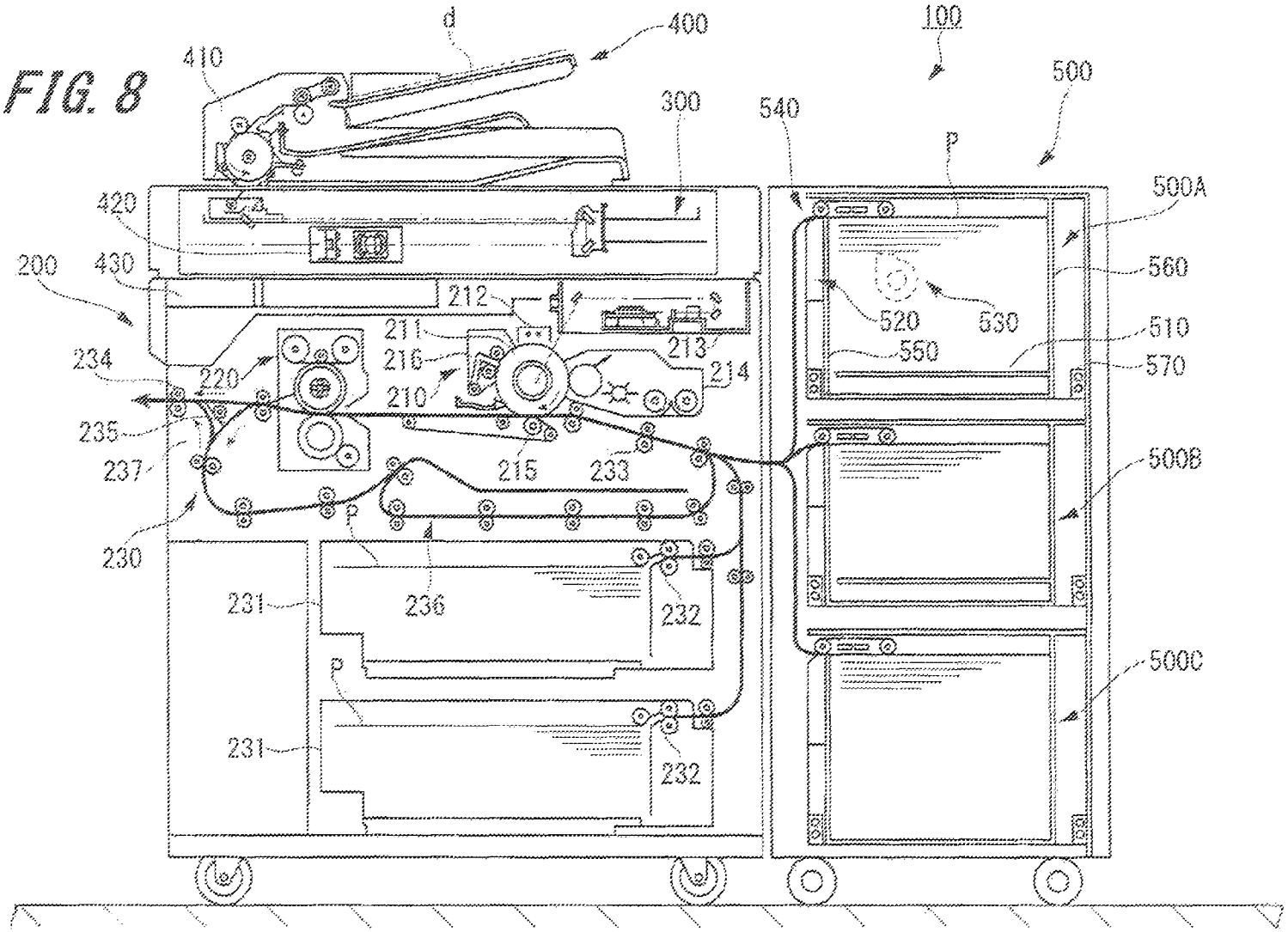
FIG. 8 is a view showing an entire configuration of an image forming apparatus which uses the sheet feeder according to the present embodiment.

FIG. 8 is a view showing an entire configuration of an example of the image forming apparatus which uses the sheet feeder 10 according to the present embodiment. As shown in FIG. 8, an image forming apparatus 100 according to the present example includes an image forming apparatus main body 200, an image reading device 300, an automatic document feeding device 400, and a sheet, feeder 500.

The image forming apparatus main body 200 has an image forming section 210, a fixing section 220, and a sheet conveying section 230. In the image forming apparatus main body 200, the image forming section 210 is configured by a photoreceptor 211, a charging section 212, an exposure section 213, a developing section 214, a transfer section 215, a cleaning section 216 and the like.

The photoreceptor 211 is an image carrier, and is driven to rotate by a drive source (not shown). The charging section 212 applies electric charges to the photoreceptor 211 so that the surface of the photoreceptor 211 is evenly charged. The exposure section 213 performs an exposure operation on the surface of the photoreceptor 211 based on the image data read from a document d, to thereby form an electrostatic latent image on the photoreceptor 211.

The developing section 214 uses a two-component developer containing toner and a carrier to develop the electrostatic latent image formed on the photoreceptor 211 into a toner image. The transfer section 215 transfers the toner image on the photoreceptor 211 to a sheet P conveyed by the sheet conveying section 230. The cleaning section 216 removes the toner remaining on the photoreceptor 211 (i.e., the cleaning section 216 cleans the surface of the photereceptor 211).

The sheet conveying section 230 includes a sheet feeding cassette 231, a first sheet feeding section 232, a second sheet feeding section 233, a sheet ejecting section 234, a conveying path switching section 235, a sheet circulating and re-feeding section 236, and a sheet reversing and ejecting section 237.

The document d placed on a platen of the automatic document feeding device 400 is conveyed to the image reading device 300 by a sheet feeding section 410. The image on one side or both sides of the document d conveyed to the image reading device 300 is exposed by an optical system and read by an image sensor 420. A signal obtained by performing photoelectric conversion by the image sensor 420 is subjected to various processing, such as analog processing, A/D conversion, shading correction, image compression and the like, in an image processing section 430. Further, the image signal having being subjected to the various processing is sent from the image processing section 430 to the exposure section 213.

In the image forming section 210, the surface of the photoreceptor 211 is charged by the charging section 212 and irradiated by laser beam, so that an electrostatic latent image is formed on the surface of the photoreceptor 211, and electrostatic latent image is developed to a toner image by the developing section 214. Next, a sheet P housed in the sheet feeding cassette 231 is conveyed by the first sheet feeding section 232. The sheet P is conveyed by the second sheet feeding section 233, which is configured by a pair of resist rollers, where the sheet P is synchronized with the toner image. Thereafter, the toner image is transferred to the sheet P in the transfer section 215, and then the toner image is fixed by the fixing section 220.

After the toner imaged has been fixed, the sheet P is ejected to the outside of the image forming apparatus main body 200 by sheer ejecting section 23. On the other hand, a process for removing the toner remaining on photoreceptor 211 after transfer is performed. When forming images on both sides of the sheet P, the sheet P having image formed on a first side thereof is sent to the sheet circulating and re-feeding section 236 where the sheet P is reversed, and an image is formed on a second side of the sheet P again in the image forming section 210, and then the sheet P is ejected to the outside of the image forming apparatus main body 200 by the sheet ejecting section 234. In the case where the sheet P is intended to be reversed and ejected, the sheet P branched off from a normal sheet ejecting path is switched in the sheet reversing and ejecting section 237 so as to be reversed, and then is ejected to the outside of the image forming apparatus main body 200 by the sheet ejecting section 234.

The sheet feeder 500 is connected to the image forming apparatus main body 200. The sheet feeder 500 is an air blowing type sheet feeder which blows air onto the image forming apparatus main body 200, to thereby feed sheets P while separating the sheets P one by one.

The sheet feeder 500 according to the present example is a large-capacity sheet feeder capable of housing a large number of sheets P, and includes, for example, three sheet feeding sections 500A, 500B, 500C. Since the three sheet feeding sections 500A, 500B, 500C basically have the same configuration, herein only the configuration of the uppermost sheet feeding section 500A will be described briefly.

The sheet feeding section 500A includes a sheet feeding tray 510, a front-end air blower 520, a lateral air blower 530, a sucking and conveying section 540, a front-end regulating member 550, a rear-end regulating member 500, a guide rail 570 and the like. The sheet feeding tray 510 can be drawn out from the sheet feeder 500 by the guide rail 570.

In the image forming apparatus 100 having the aforesaid configuration, the sheet feeder 10 according to the above embodiment can be used as the sheet feeder 500 (to be specific, the sheet feeding sections 500A, 500B, 500C of the sheet feeder 500). The correspondence relationship of the main components between FIG. 8 and FIGS. 1 and 2 is: the front-end air blower 520 corresponds to the front air blower 18, the lateral air blower 530 corresponds to the lateral air blowers 20A, 20B, and the sucking and conveying section 540 corresponds to the sucking and conveying section 13.

Thus, in the image forming apparatus 100, such as a copying machine, having a sheet feeder, by applying the sheet feeder 10 of the aforesaid embodiment to the sheet feeder of the image forming apparatus 100, the air blowing amount for floating the sheets can be automatically adjusted to appropriate level without necessity for the user to perform operation while confirming the floating state of sheets by visual observation, and without necessity for the controller 30 to perform complicated operation.

Although described above is an example in which the image forming apparatus 100 that uses the sheet feeder 10 of the aforesaid embodiment is a copying machine, the present invention is not limited to this example. To be specific, the sheet feeder 10 may be applied to any kind of image forming apparatus equipped with an air blowing type sheet feeder, such as a printer, a facsimile machine, a printing machine, a composite machine or the like.

What is claimed is:

1. A sheet feeder comprising:

an air blower adapted to blow air onto an end face of a stacked sheet bundle to thereby float the sheets of the sheet bundle;

a conveying section adapted to convey the uppermost floated sheet;

a brightness measuring section adapted to measure brightness of light reflected from the end face of the sheet bundle at two or more points in the height direction of the sheet bundle, the brightness measuring section including at least two brightness sensors arranged one above the other in a height direction of the sheets of the stacked sheet bundle;

a determination unit adapted to determine, based on the brightness of each point measured by the brightness measuring section, whether or not the air blowing amount of the air blower is appropriate; and a controller adapted to control the air blowing amount of the air blower based on the determination of the determination unit, wherein the determination unit determines whether or not the brightness of each point measured by the brightness measuring section is equal to or higher than a predetermined lower limit value and whether or not the brightness of each point measured by the brightness measuring section is within a range defined by the lower limit value and an upper limit value, and determines, if the determination result is positive, that the air blowing amount of the air blower is appropriate.

2. The sheet feeder according to claim 1, wherein, before the sheet feeding operation of the sheet feeder has started, the determination unit executes a routine to perform the determination while the controller changes the air blowing amount of the air blower until the determination result becomes positive, to thereby automatically adjust the air blowing amount of the air blower.

3. The sheet feeder according to claim 2, wherein the routine is executed during the sheet feeding operation of the sheet feeder, in addition to the time before the sheet feeding operation of the sheet feeder has started.

4. The sheet feeder according to claim 1, wherein the determination unit has information about setting range of the brightness stored therein, wherein the setting range has a lower limit value which is equal to the predetermined lower limit value and a width which is equal to the predetermined value, and determines whether or not the brightness of each point measured by the brightness measuring section falls within the setting range, and determines, if the determination result is positive, that the air blowing amount of the air blower is appropriate.

5. The sheet feeder according to claim 4, wherein the determination unit has the information about setting range stored therein for each size and/or type of sheet, and performs the determination using the information about setting range suitable for the size and/or type of the stacked sheet bundle.

6. The sheet feeder according to claim 1, wherein a plurality of the brightness measuring sections are arranged around the sheet bundle.

7. The sheet feeder according to claim 1, wherein, before sheet feeding operation of the sheet feeder has started, the controller acquires, after causing the air blower to drive, the brightness measured by the brightness measuring section, determines whether or not the air blowing amount of the air blower is appropriate based on the acquired brightness, and controls the air blowing amount of the air blower based on the determination result.

8. The sheet feeder according to claim 7, wherein the brightness measuring section includes two or more brightness sensores arranged in the height direction of the sheet bundle at a predetermined interval.

9. The sheet feeder according to claim 7, wherein, in the beginning, the controller sets and drives the air blower so that the air blowing amount becomes the lowest, and if it is determined that the air blowing amount of the air blower is not appropriate, the controller will increase the air blowing amount of the air blower.

10. The sheet feeder according to claim 7, wherein the controller determines whether or not the brightness of each point measured by the brightness measuring section is equal to or higher than a predetermined lower limit value and the range of the brightness of each point is equal to or smaller than a predetermined value, and determines, if the determination result is positive, that the air blowing amount of the air blower is appropriate.

11. The sheet feeder according to claim 10, wherein the controller has information about setting range of the brightness stored therein, wherein the setting range has a lower limit value which is equal to the predetermined lower limit value and a width which is equal to the predetermined value, and determines whether or not the brightness of each point measured by the brightness measuring section falls within the setting range, and determines, if the determination result is positive, that the air blowing amount of the air blower is appropriate.

12. The sheet feeder according to claim 11, wherein the controller has the information about setting range stored therein for each size and/or type of sheet, and performs the determination using the information about setting range suitable for the size and/or type of the stacked sheet bundle.

13. The sheet feeder according to claim 10, wherein, before sheet feeding operation of the sheet feeder has started, the controller executes a routine to perform the determination while changing the air blowing amount of the air blower until the determination result becomes positive, to thereby automatically adjust the air blowing amount of the air blower.

14. The sheet feeder according to claim 13, wherein the routine is executed during the sheet feeding operation of the sheet feeder, in addition to the time before the sheet feeding operation of the sheet feeder has started.

15. An image forming apparatus comprising:

an image forming section adapted to transfer a toner image formed on a photoreceptor to a sheet; and a sheet feeding section adapted to feed sheets to the image forming section, wherein the sheet feeding section comprises:

an air blower adapted to blow air onto an end face of a stacked sheet bundle to thereby float the sheets of the sheet bundle;

a conveying section adapted to convey the uppermost floated sheet;

a brightness measuring section adapted to measure brightness of light reflected from the end face of the sheet bundle at two or more points in the height direction of the sheet bundle, the brightness measuring section including at least two brightness sensors arranged one above the other in a height direction of the sheets of the stacked sheet bundle;

a determination unit adapted to determine, based on the brightness of each point measured by the brightness measuring section, whether or not the air blowing amount of the air blower is appropriate; and a controller adapted to control the air blowing amount of the air blower based on the determination of the determination unit, wherein the determination unit determines whether or not the brightness of each point measured by the brightness measuring section is equal to or higher than a predetermined lower limit value and whether or not the brightness of each point measured by the brightness measuring section is within a range defined by the lower limit value and an upper limit value, and determines, if the determination result is positive, that the air blowing amount of the air blower is appropriate.

16. The image forming apparatus according to claim 15, wherein, before the sheet feeding operation of the sheet feeder has started, the determination unit executes a routine to perform the determination while the controller changes the air blowing amount of the air blower until the determination result becomes positive, to thereby automatically adjust the air blowing amount of the air blower.

17. The image forming apparatus according to claim 16, wherein the routine is executed during the sheet feeding operation of the sheet feeder, in addition to the time before the sheet feeding operation of the sheet feeder has started.

18. The image forming apparatus according to claim 15, wherein the determination unit has information about setting range of the brightness stored therein, wherein the setting range has a lower limit value equal to the predetermined lower limit value and a width equal to the predetermined value, and determines whether or not the brightness of each point measured by the brightness measuring section falls within the setting range, and determines, if the determination result is positive, that the air blowing amount of the air blower is appropriate.

19. The image forming apparatus according to claim 18, wherein the determination unit has the information about setting range stored therein for each size and/or type of sheet, and performs the determination using the information about setting range suitable for the size and/or type of the stacked sheet bundle.

20. The image forming apparatus according to claim 15, wherein a plurality of the brightness measuring sections are arranged around the sheet bundle.

* * * * *